US007690515B2

(12) United States Patent
Thibodeau

(10) Patent No.: US 7,690,515 B2
(45) Date of Patent: Apr. 6, 2010

(54) CONTAINER/CARGO RACK WITH INTEGRATED LOCK DOWN AND INDEXING SLIDE

(76) Inventor: Tim Albert Thibodeau, 12239 Mosielee, Houston, TX (US) 77086

( * ) Notice: Subject to any disclaimer, the term of this patent is extended or adjusted under 35 U.S.C. 154(b) by 862 days.

(21) Appl. No.: 10/906,464

(22) Filed: Feb. 22, 2005

(65) Prior Publication Data

US 2005/0184020 A1 Aug. 25, 2005

Related U.S. Application Data

(60) Provisional application No. 60/521,117, filed on Feb. 23, 2004.

(51) Int. Cl.
*B42F 17/00* (2006.01)

(52) U.S. Cl. ..... 211/11

(58) Field of Classification Search ..... 211/4, 211/8, 59.2, 59.3, 186, 195, 11, 84, 189, 211/85.18, 85.22; 312/72; 280/47.18; 206/503; 108/102, 137, 143

See application file for complete search history.

(56) References Cited

U.S. PATENT DOCUMENTS 1,702,987 A * 2/1929 Wilson ..... 211/59.3
2,098,844 A * 11/1937 Waxgiser ..... 211/59.3
2,980,259 A * 4/1961 Fowlds ..... 211/59.3
3,436,093 A * 4/1969 Ruffley, Jr. ..... 280/47.27
4,023,682 A * 5/1977 Niece ..... 211/184
4,143,784 A * 3/1979 Frahm et al. ..... 215/12.1
4,418,969 A * 12/1983 Hettman ..... 312/249.9
4,431,107 A * 2/1984 Bergstrom et al. ..... 211/59.4
4,562,928 A * 1/1986 Erickson ..... 211/184
5,370,245 A * 12/1994 Tersch et al. ..... 211/74
5,411,146 A * 5/1995 Jarecki et al. ..... 211/59.2
5,797,487 A * 8/1998 Young ..... 206/308.2
5,846,043 A * 12/1998 Spath ..... 414/343
5,913,527 A * 6/1999 Hailston ..... 280/47.28
6,003,654 A * 12/1999 Webber et al. ..... 198/408
6,135,297 A * 10/2000 DeShazo et al. ..... 211/74
6,142,300 A * 11/2000 Kelly et al. ..... 206/503
6,247,710 B1 * 6/2001 Luberda ..... 280/47.28
6,302,414 B1 * 10/2001 Berthiaume et al. ..... 280/47.18
6,527,127 B2 * 3/2003 Dumontet ..... 211/59.3
6,719,151 B2 * 4/2004 Close ..... 211/59.3
6,811,042 B2 * 11/2004 Kelly et al. ..... 211/74
6,851,563 B1 * 2/2005 Lipari ..... 211/74
7,107,728 B2 * 9/2006 Whitley ..... 52/167.4
7,150,365 B2 * 12/2006 Hardy et al. ..... 211/189
7,195,257 B2 * 3/2007 Stoneback et al. ..... 280/79.6
2002/0043509 A1 * 4/2002 Lajeunesse et al. ..... 211/59.2
2004/0113529 A1 * 6/2004 Goldin ..... 312/72
2005/0184020 A1 * 8/2005 Thibodeau ..... 211/189
2006/0016774 A1 * 1/2006 Bustos ..... 211/186
2007/0012541 A1 * 1/2007 Boydston et al. ..... 194/205
2007/0221593 A1 * 9/2007 Apps ..... 211/74
2008/0083683 A1 * 4/2008 Apps et al. ..... 211/74
2008/0209918 A1 * 9/2008 White ..... 62/50.1
2008/0308383 A1 * 12/2008 Boydston et al. ..... 194/205

* cited by examiner

*Primary Examiner*—Sarah Purol
(74) *Attorney, Agent, or Firm*—Furr Law Firm; Jeffrey Furr

(57) ABSTRACT

The present invention is a container rack that locks down the containers to prevent shock and vibration damage to the containers. The device consists of a rack structure, a trombone means which is used to pull the containers forward, a lock down means to hold the containers in place and a closing means which is used to close the lock down means in place.

21 Claims, 12 Drawing Sheets

Front

Side

Top

Handle Down

Handle Up

Trumbone In

Trombone Out

CONTAINER/CARGO RACK WITH INTEGRATED LOCK DOWN AND INDEXING SLIDE

RELATED APPLICATION

This application claims the benefit of U.S. Provisional Application No. 60/521,117, filed Feb. 23, 2004.

BACKGROUND OF INVENTION

This invention relates to a method and a device for locking down containers/cargo and more particular the locking down of containers for safer transporting.

1. Background

There is a large demand for bottled water with an increased concern about the purity and potability of municipally provided water supplies. The commercially provided bottled water is said to be purer and better tasting than what comes out of the tap.

Drinking beverages, such as spring water and others, is typically sold commercially in a plurality of different bottle sizes. An economical way to sell bottled water is to put it in large containers of 5 gallons or more.

The most common type of commercially available bottled water dispensers are of an inverted bottle type construction wherein the bottle is turned upside down into an open receptacle or well which is on top of the cooler dispenser. The most common bottle receptacle of these re-usable polymeric bottles is a standard 5-gallon plastic jug having a narrow mouth and a flat bottom portion. These 5-gallon jugs have two or more annular rims extending outwardly from the bottle side wall to facilitate carrying of the jugs and to provide rolling surfaces when the jugs are rolled on their sides. Such size gallon bottled water containers are commercially available from a number of sources and are typically returned by the user when the water has been consumed there from. The jugs must be transported to and from the filling plant and are typically sterilized before refilling.

These bottled water jugs are normally delivered by delivery trucks. These trucks have a rack that places them horizontally. This horizontal position facilitates movement and storage of the container while on the delivery truck.

At the top of the list of every major analysis of bottle mortality is transit damage in racks. The shock and vibration during over the road transportation cause both hairline and catastrophic damage to full bottles. Many routes have such poor roads (and the resulting elevated damage and claims) that they are financially untenable for bottling companies and service is not offered.

Bottle designers have traditionally been restricted in the features used in water bottles because convenience features reduce bottle life. Designs that do not maintain a continuous round perimeter, i.e. handled bottles, are structurally unable to dissipate the dynamic stresses of the rack and the bottles crack or break near the handle.

During delivery, the driver is most vulnerable when unloading bottles from the upper tiers of the rack. Full bottles weigh upwards of 40 lbs., and reaching to the back cavity of the rack requires pulling a full bottle forward and assuming the weight while in a vulnerable position. At elevated heights, the opportunity to lose balance, lose control of the bottle or even drop it from 10 feet or more increases dramatically.

There is still room for improvement in the art.

SUMMARY OF INVENTION

The present invention relates to a container/cargo rack that locks down the containers/cargo to prevent shock and vibration damage to the containers/cargo. The device consists of a rack structure, a trombone means which is used to pull the containers/cargo forward, a lock down means to hold the containers/cargo in place and a closing means which is used to close the lock down means in place.

An objective of the current invention is to enhance driver and route efficiency. Additionally, an objective is that the driver will be less likely to return to base with full bottles, making the route more productive and route productivity will also be enhanced because bottles will not migrate up against the delivery door causing the door to jam shut. The device will make the driver activity more productive during unloading, lower the overall time spent at each delivery point, and reduce or eliminate the possibility of returning full bottles to base.

Another objective of the current invention is to improve driver safety in multiple dimensions while reducing injuries, lost time, and workman's compensation expenses for delivery truck operations.

A further objective of the current invention is to reduce the incidence and payment of consumer claims. Bottle life and functionality will be vastly improved through the use of this device. Overall, the device will deliver a quantum reduction in transit damage and the resulting extension of asset life for bottlers, and open new geography.

The current invention will enable unprecedented design flexibility for bottlers and convenience to their customers.

BRIEF DESCRIPTION OF DRAWINGS

Without restricting the full scope of this invention, the preferred form of this invention is illustrated in the following drawings:

FIG. 6 displays a side view with the trombone in;

DETAILED DESCRIPTION

Figure 1A:
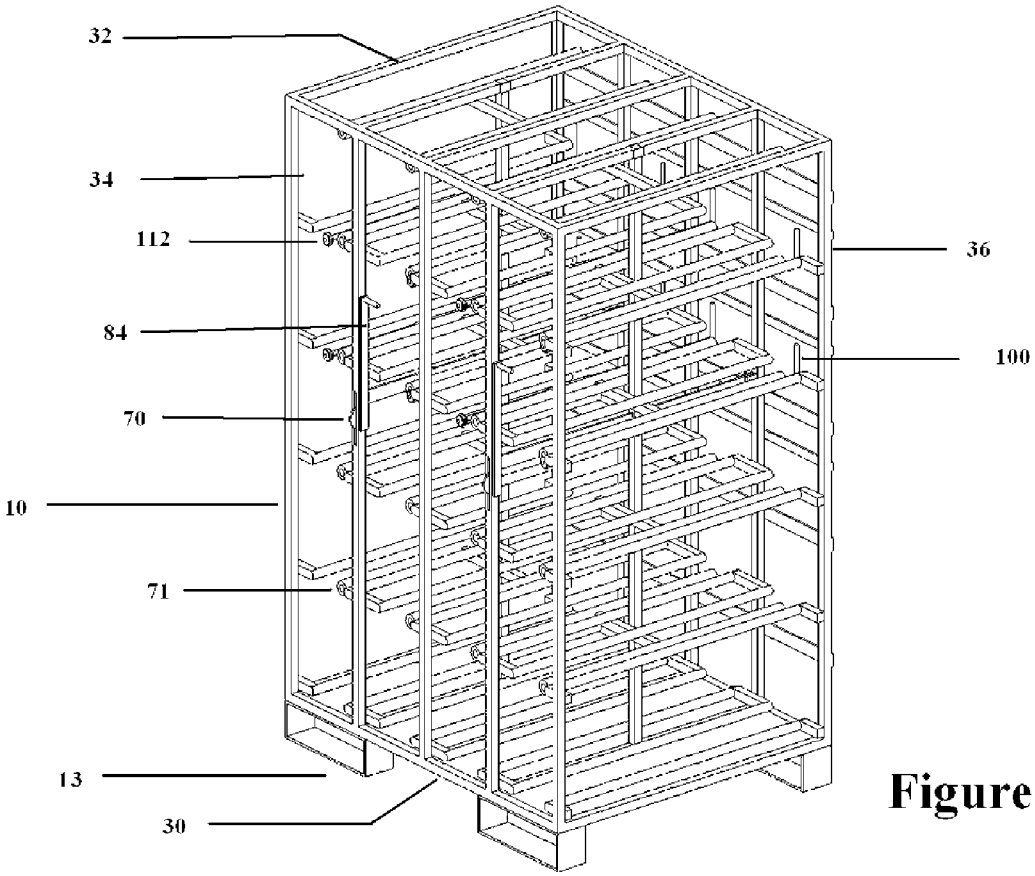
FIG. 1*a* shows a perspective front view of basic rack used for the transportation of containers.
Figure 1B:
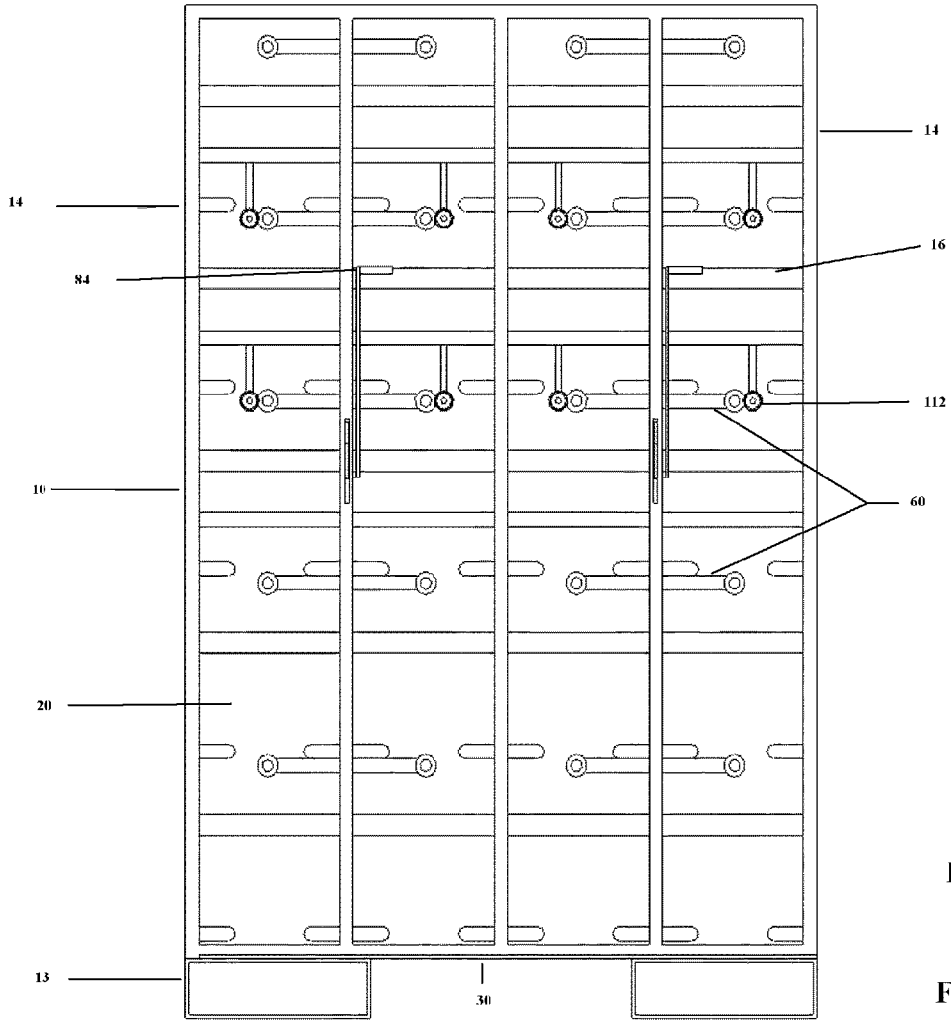
FIG. 1*b* shows a front view of the current invention.
Figure 2:
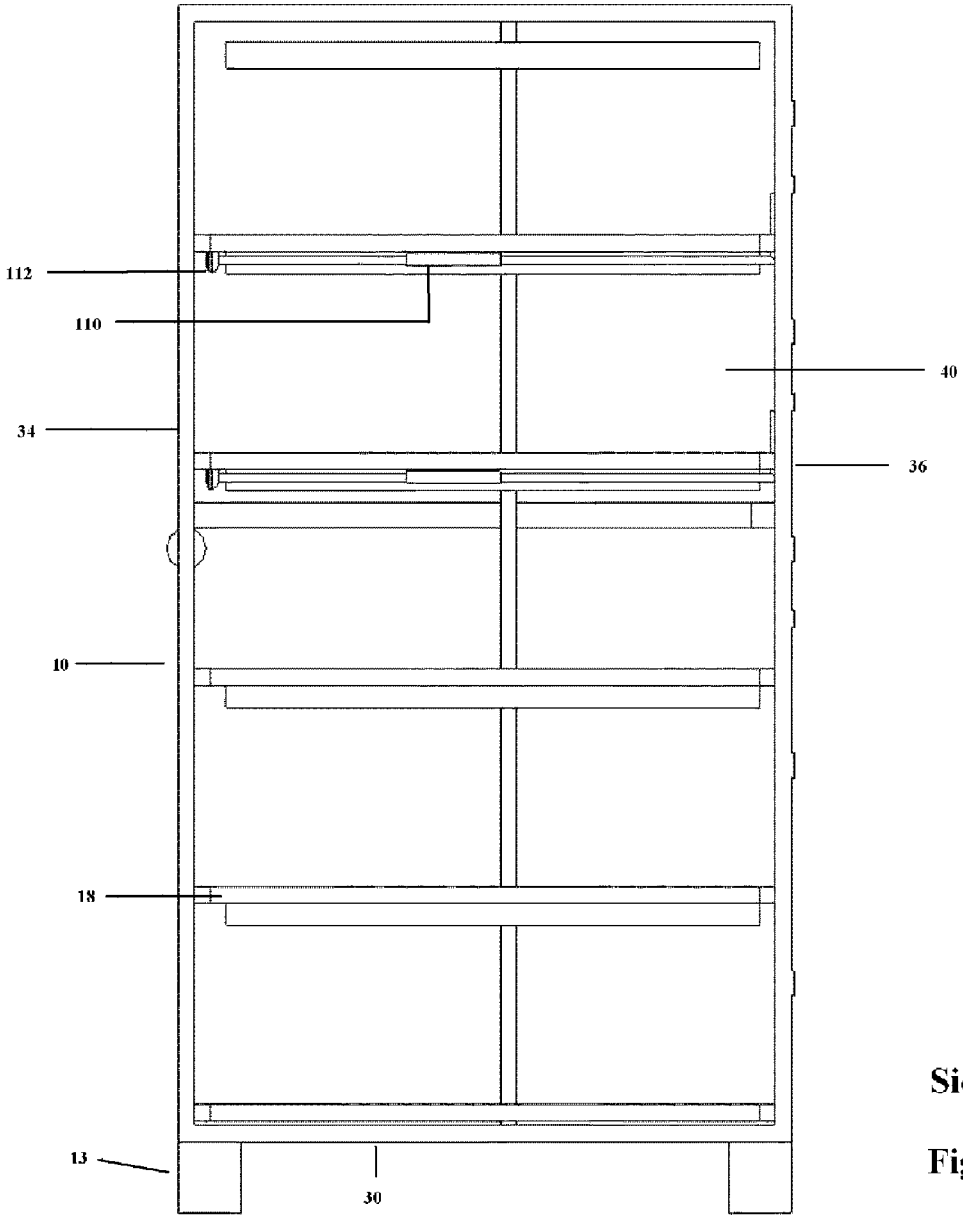
FIG. 2 shows a side view of the current invention.
Figure 3:
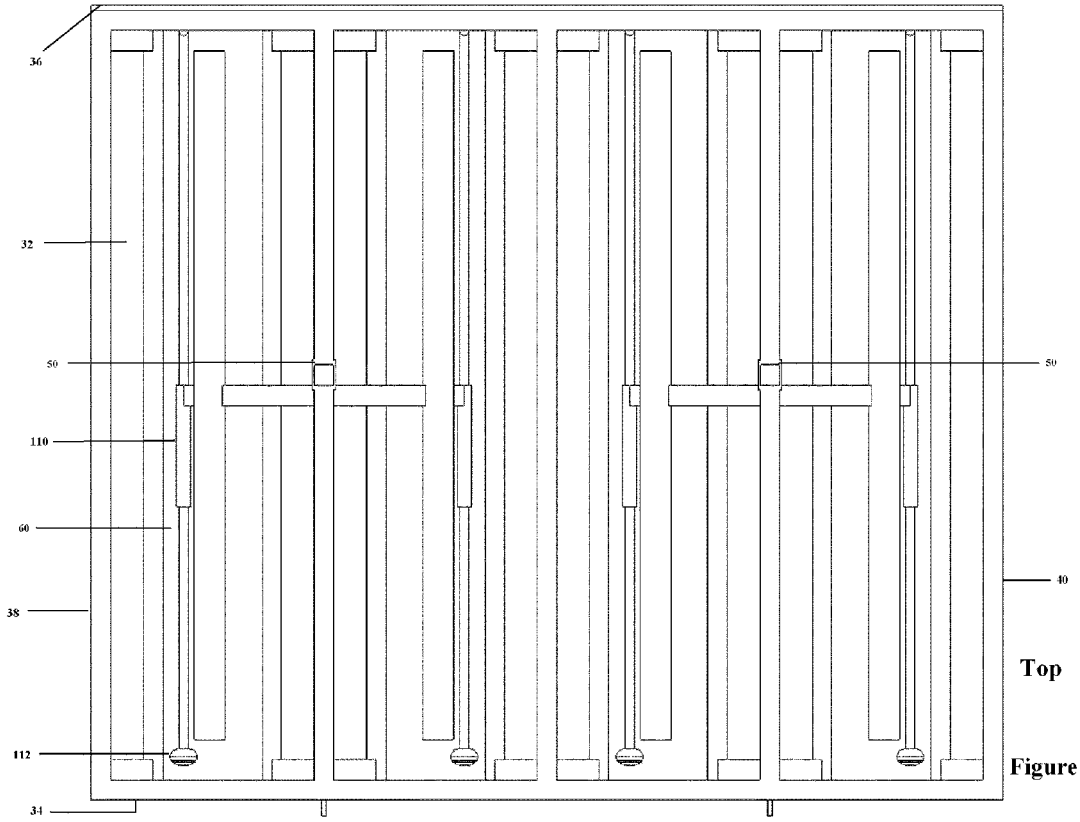
FIG. 3 shows a top view of the current invention.
Figure 4:
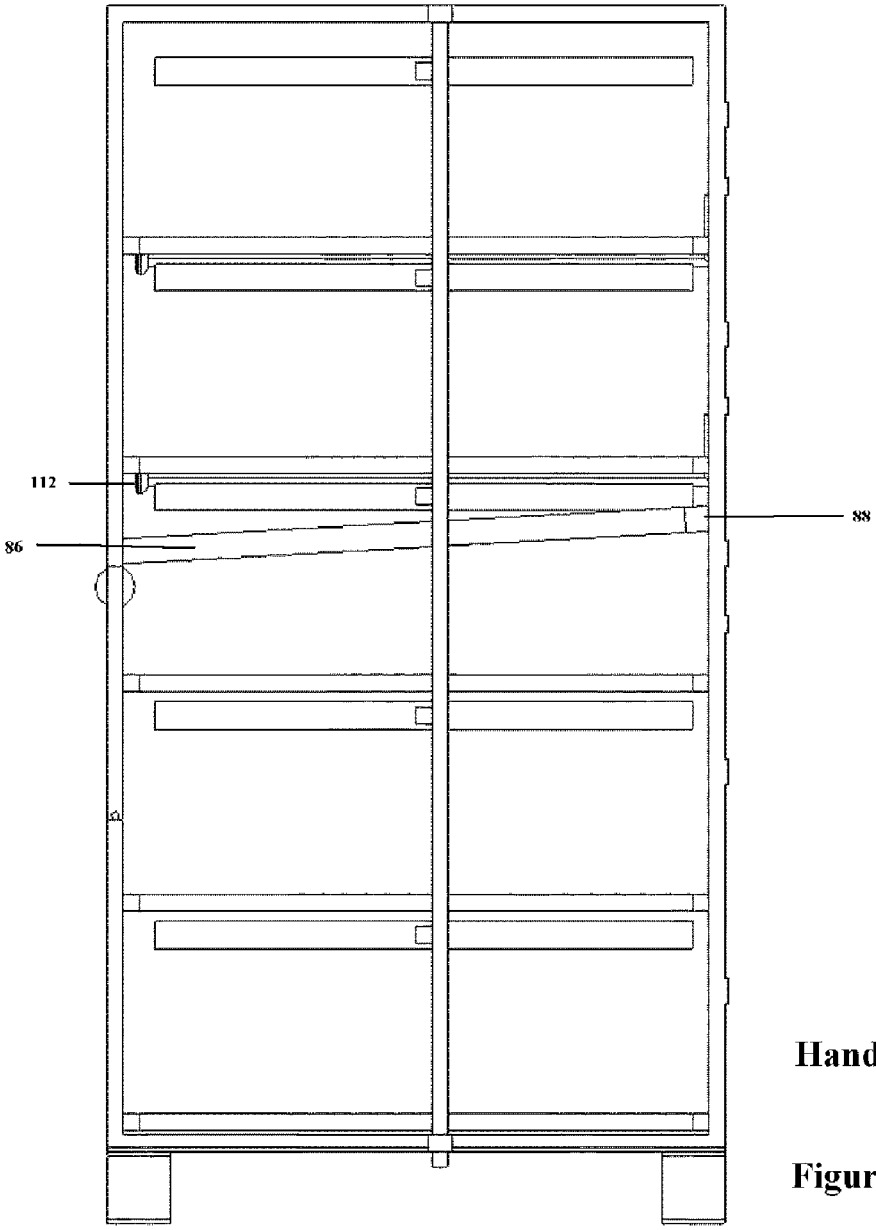
FIG. 4 shows a side view with the handle down.
Figure 5:
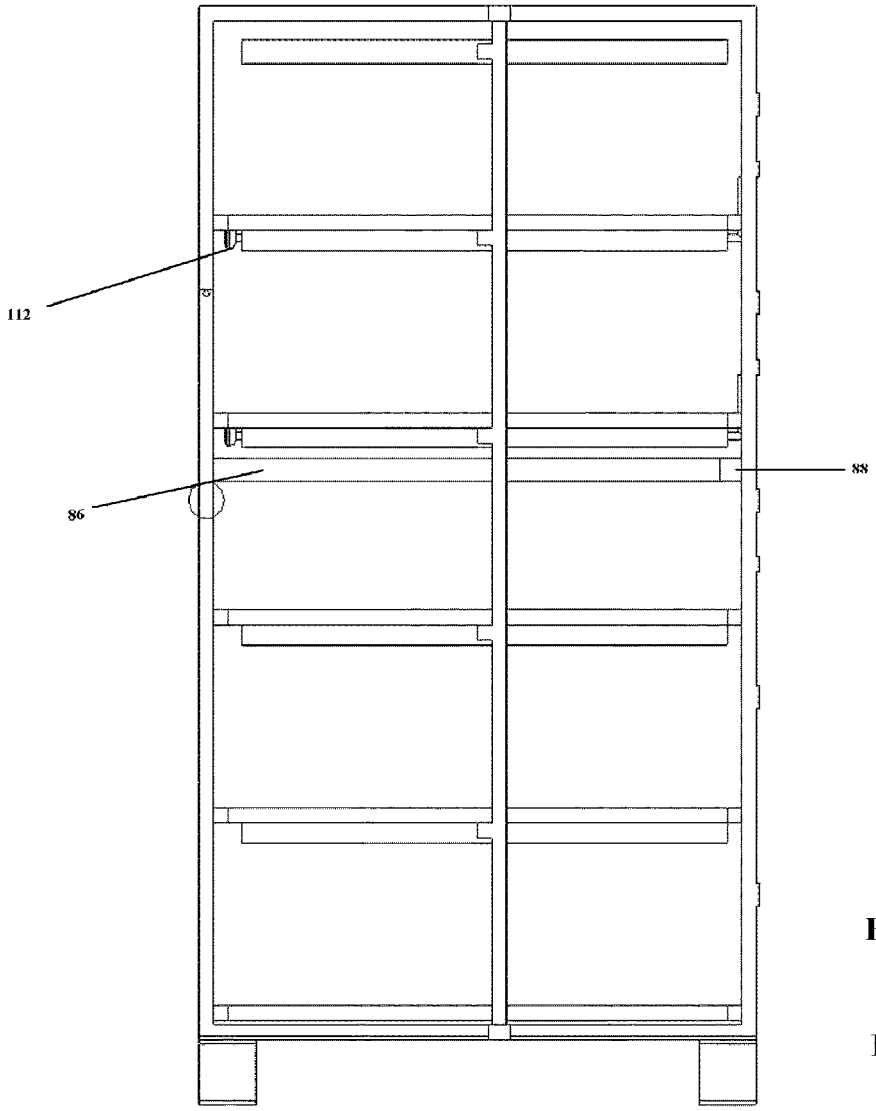
FIG. 5 shows a side view with the handle up.

The following description is demonstrative in nature and is not intended to limit the scope of the invention or its application of uses.

There are a number of significant design features and improvements incorporated within the invention.

Referring to FIG. 1*a*-6, there is shown a standard water bottle rack 10 in accordance with an embodiment of the present invention. The water bottle rack 10 includes a peripheral frame 20 made of structural steel so as to form a generally parallelepiped shaped outer frame.

A typical rack has a height substantially in range of 68", a width substantially in the range of 48" and a depth substantially in the range of 40". Typically, these dimensions allow for the storage of 40 conventional 5-gallon water jugs. It should be understood that the rack 10 could have other configurations, construction materials and sizes without departing from the scope of the present invention.

A typical rack 10 has vertical 14, lateral 16 and side 18 supports made of a structurally sound material such as metal like galvanized steel. These supports form a plurality of rectangular cells 200. These cells can also be molded and constructed in plastic. Each of these cells is deep enough to store two standard containers 25 such as water bottles. The side 18 supports also serve as a resting place for the containers 25.

The rack 10 has a bottom 30, top 32, front 34, back 36, left 38 and right 40 sides. The bottom 30 has a metal sheet. The rack 10 has four feet 13 on the bottom 30. These feet 13 are positioned at the corners and so that the rack 10 can be moved with a forklift. The device has a trombone means 60, lock down means 65 and a close means 70.

Figure 6:
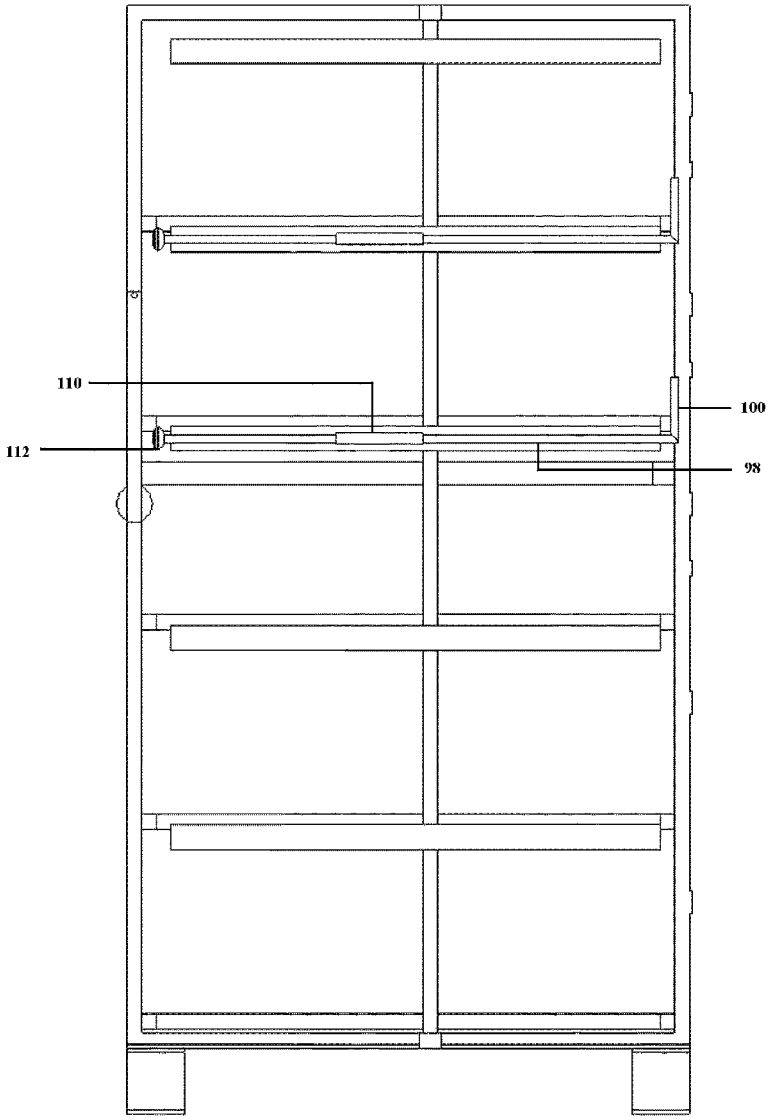
Figure 7:
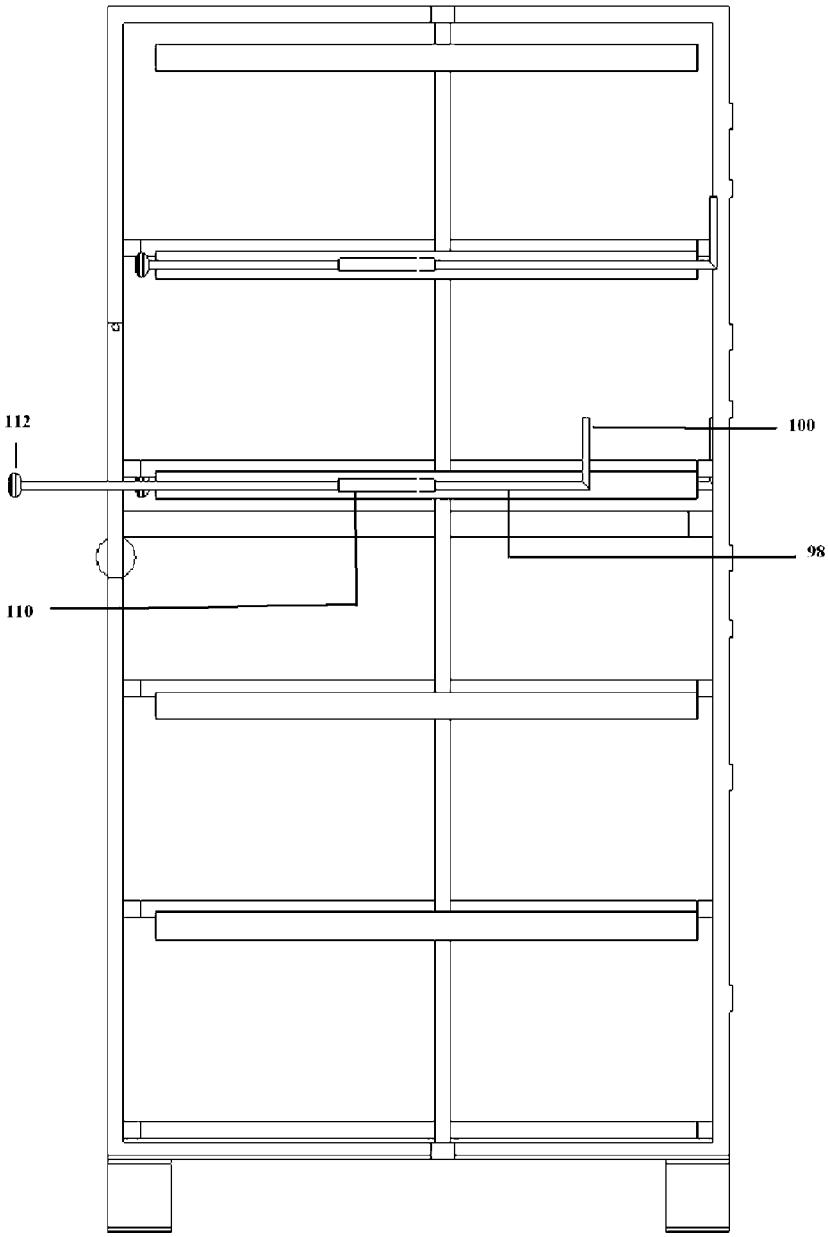
FIG. 7 displays a side view with the trombone out.
Figure 10:
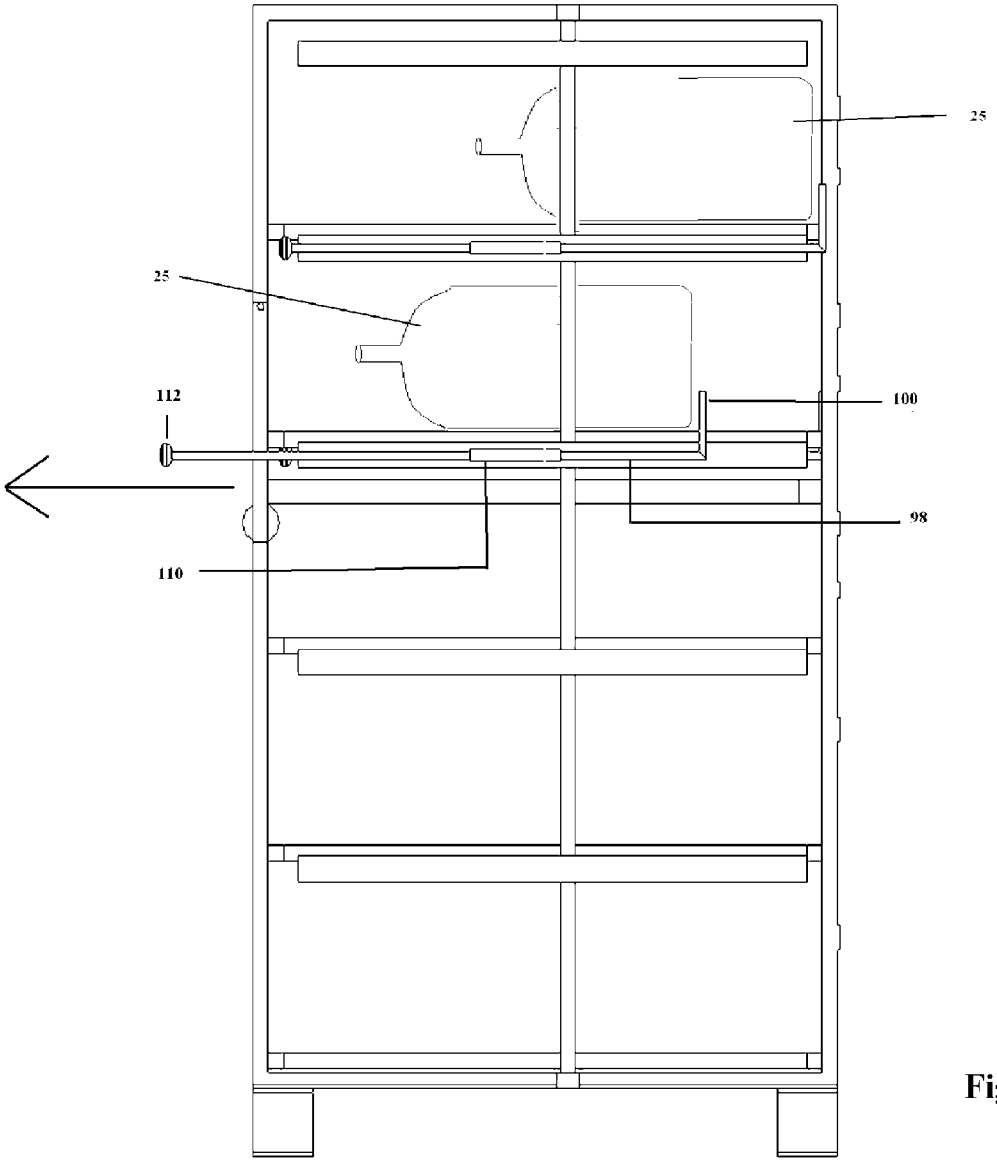
FIG. 10 shows the trombone means being used.

As shown in more detail in FIGS. 6, 7, and 10 the device 1, preferred embodiment, is a rack 10 with a trombone means 60 which is used to move the containers 25 out of the cells 20, a lock down means 65 and a close and tensioning means 70. The close and tensioning means 70 runs through a post 64 which runs the height of the rack 10. The posts 64 extend through guides 50. The posts 64 can have an additional tensioning means such as a spring attached from posts 64 to the base of the rack 10. The tension means 70, 67 provides a downward force which is transferred to the lock down means 65. A post 64 can have one or more lock down means 65 attached to it, one or more per container 25 in the cell 22.

Figure 8:
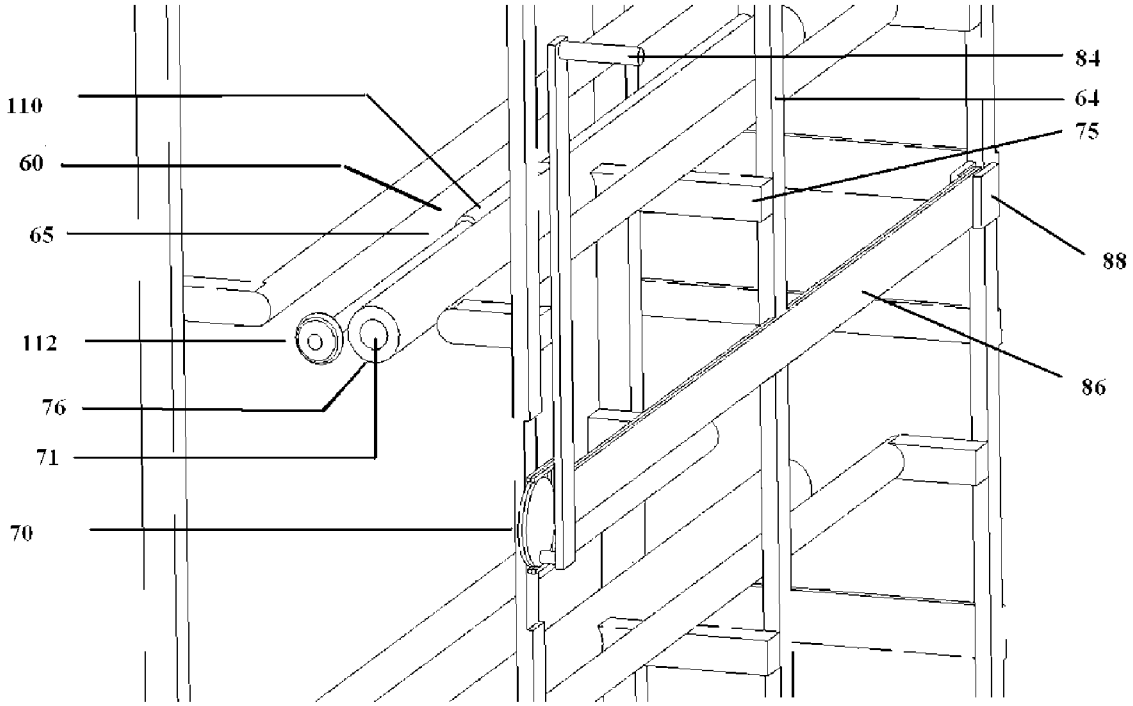
FIG. 8 displays the lock down and trombone means.

The lock down means 65 of the preferred embodiment is shown in FIG. 8. The frame 75 is attached to the post 64. Attached to the end of the frame 75 is the lock down tube 71. Surrounding the lock down tube 71 is multiple numbers of plastic or rubber buffers 76 which encircle the lock down tube 71. When the lock down means 65 is brought down by the close and tensioning mean 70 the buffer 76 are brought into contact with the container 25 holding it down and in place. The buffers 76 are compressible so that the containers 25 are held even with uneven container 25 sizes.

Figure 9A:
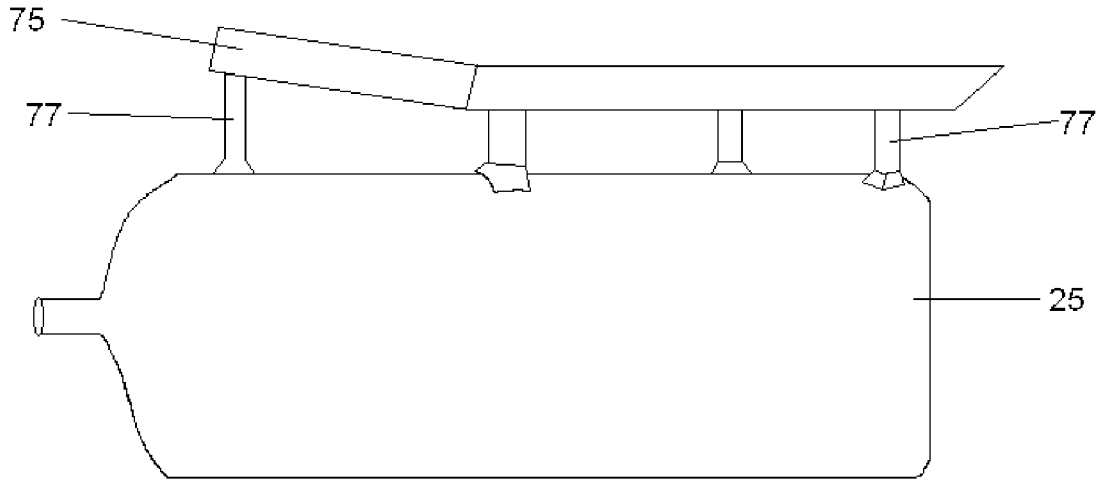
FIGS. 9*a* and 9*b* displays alternative additional embodiments of the lock down means.

In an additional embodiment as shown in FIG. 9*a*, it consists of a lock down frame 75 from which lock down appendages 77 extend out from the lock down frame 75. The lock down appendages 77, in the preferred embodiment, has rubber tips 79 on their ends. These lock down appendages 77 touch and apply force to the container 25 holding it in place and preventing vibration from transporting. The rubber tips 79 are compressible so that the containers 25 are held even with uneven container 25 sizes. In the preferred embodiment, the appendages 77 and frame 75 are made of thin metal strips with some elasticity.

Figure 9B:
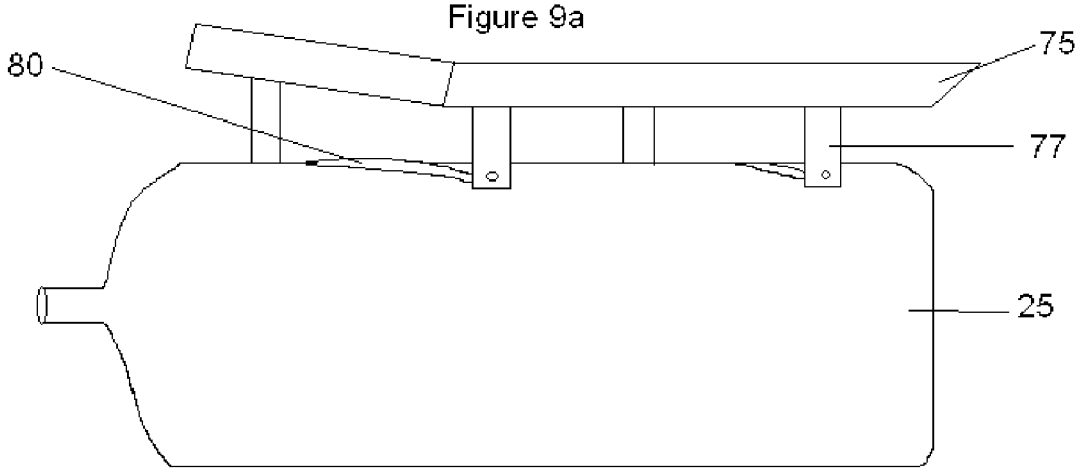

In an alternative embodiment as shown in FIG. 9*b*, the lock down frame 75 would have a plurality of appendages 77 positioned on opposite ends of the container 25 and extending below the top of the container 25 with a tension device 80 such as an elastic cord or rope connected on two of the plurality of appendages 77 across the container 25 to hold the container down.

The close means 70 is a hinging mechanism that closes the lock down means 65 on the containers. The close and tensioning means 70 has a handle 84. The handle 84 can be rotated. The handle 84 is rotated up, the close means 70 rotates applying an upward force on hinge bar 86 causing post 64 to raise thereby opening lock means 65. When the handle 84 is rotated down in its locking position the close means 70 applies a downward force on hinge bar 86 causing post 64 to lower thereby closing the lock means 65.

The close means 70 has a bar 86 on which a plurality of lock down means 65 are connected. There is one lock down means 65 per post 64. The lock down means 65 is on the end of the bar 75 in the preferred embodiment. The back of the bar 86 is connected to the frame in the back of the cell 22 to a hinge 88 or pivot means. The handle 84 is attached to close and tensioning means 70. The close and tensioning means 70 rides in between a top and bottom plate on hinge bar 86. When the handle 84 is rotated down, the bar 86 is pulled down and bringing the lock down means 65 in contact with the container 25. When the handle 84 is rotated up, it pushes the bar 86 up and releasing the containers 25 from the lock down means 65.

FIGS. 6, 7, 8 and 10 show the trombone means 60. In its simplest form the trombone means 60 is a long pole 98 with a hook 100 in a track 110. The hook 100 extends from the pole 98 at a ninety degree angle and extends beyond the upper portion of the container 25. The pole 98 has a pull knob 112 opposite the hook 100. When the pull knob 112 is pulled the hook 100 hooks the bottom of the container 25 in the cell 22 and pulls the container 25 forward with the hook 100.

In an alternative embodiment, a screw mechanism with a hook can also be used or the trombone means 60 can be connected to the frame of the cell 22 instead of being incorporated into the bar 75.

Figure 11:
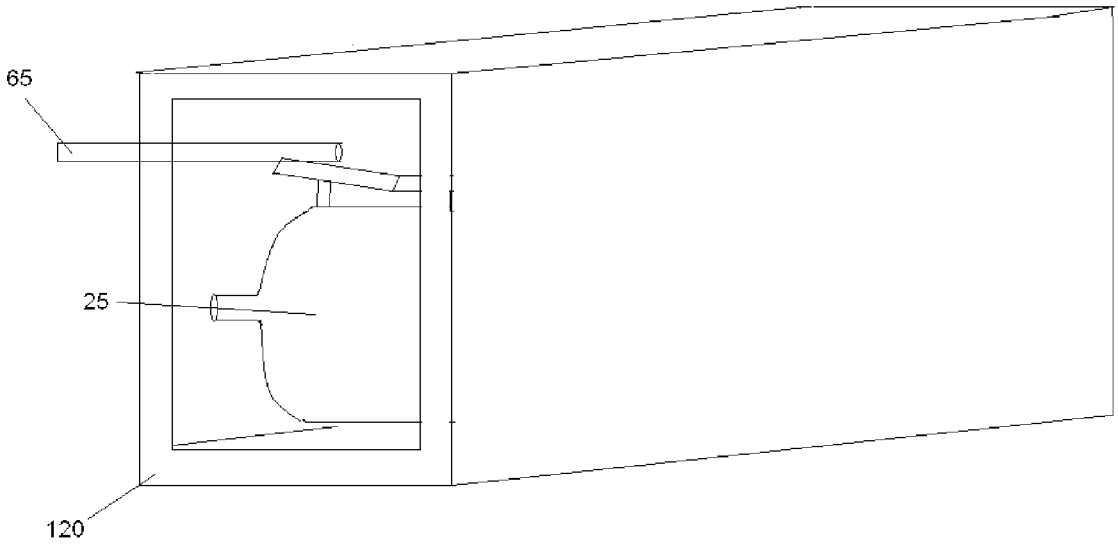
FIG. 11 shows the device being used with a plastic side rack.

FIG. 11 displays the device 1 being used with a standard semi-circle plastic container holder. The locking means 65 is attached to the semi-circle holder 120 locking the containers 25 in place.

The device 1 will enhance driver and route efficiency. The trombone means 60 feature will prevent reaching into the back cavities of the racks for full bottles, saving time during unloading. The ability to see the back cavities and access them productively will make the driver more efficient. Additionally, the driver will be less likely to return to base with full bottles, making the route more productive.

The device 1 will increase route productivity because the containers will not migrate up against the delivery door. At the top of the list of every major analysis of bottle mortality is transit damage in racks. The shock and vibration during over the road transportation cause both hairline and catastrophic damage to full bottles. Many routes have such poor roads (and the resulting elevated damage and claims) that they are financially untenable for bottling companies and service is not offered.

During delivery, the driver is most vulnerable when unloading bottles from the upper tiers of the rack. Full bottles weigh upwards of 40 lbs., and reaching to the back cavity of the rack requires pulling a full bottle forward and assuming the weight while in a vulnerable position. At elevated heights, the opportunity to lose balance, lose control of the bottle or even drop it from 10 feet or more increases dramatically. The trombone means 60 prevents the driver from getting into the "reach" position at any level on the truck.

The lock down means 65 prevents container 25 migration out of the rack 10 during transit, preventing containers 25 from falling out of the truck onto the driver when the door is opened. It also prevents door jams and the resulting intervention between door and rack that drivers must perform in order to access racked containers 25.

The lock down means 65 locks each container 25 in place and damps vibration to prevent typical stresses and breakage. The device 1 will deliver a quantum reduction in transit damage and the resulting extension of asset life for bottles, and opens new geography to water routes.

Use of the device 1 will enable unprecedented design flexibility for bottlers and convenience to their customers. Bottle designers have traditionally been restricted in the features used in containers 25 because convenience features reduce bottle life. Designs that do not maintain a continues round perimeter, i.e. handled bottles, are structurally unable to dissipate the dynamic stresses in a typical rack and the bottles crack or break near the handle. The lock down means 65 in the product will enable handled bottles to survive at, near or above the rate of round bottles. The ability of bottlers to offer the convenience of handled or non-symmetrically shaped bottles, without the resulting early mortality, will open the door on consumer and brand friendly designs.

ALTERNATIVE EMBODIMENT

In an alternative embodiment, the lock down means 65 can be made of ropes, straps, bars, cables, bands, beams, cords, and any other similar material. The lock down means 65 can apply the lockdown force from any direction. The close means 70 can be activated by levers, gears, cams, hinges, clamps, and other mechanical devices. The trombone means 60 can consist of slides, rollers, bearings, springs, and screws (augers). The material that the device 1 can be made of can include plastic, metals, alloys that are welded, glued, or mechanically fastened together.

CONCLUSION

The device will enhance driver and route efficiency. Additionally, with the device, the driver will be less likely to return to base with full bottles, making the route more productive and route productivity will also be enhanced because bottles will not migrate up against the delivery door. The device will make the driver activity more productive during unload, lower the overall time spent at each delivery point, and reduce or eliminate the possibility of returning full bottles to base. Use of the device will improve driver safety in multiple dimensions while reducing injuries, lost time, and workman's compensation expenses for delivery truck operations. Use of the device will reduce the incidence and payment of consumer claims from broken or leaking bottles. Bottle life and functionality will be vastly improved through the use of this device. Overall, the device will deliver a quantum reduction in transit damage and the resulting extension of asset life for bottlers, and open new geography. Use of the device will enable unprecedented design flexibility for bottlers and convenience to their customers.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents that may be resorted to fall within the scope of the invention.

What is claimed is:

1. A device comprising: a rack where said rack has vertical, lateral and side supports, a trombone means which is comprised of a long pole with a hook on one end and a pull knob on the other end in a track which is connected to the supports of said rack, a locking means connected to the supports of said rack and a closing means connected to the supports of said rack, where said trombone means connected to said rack is actuated by said pull knob and by which said hook moves a water bottle from the rear to the front of said rack positioning it so that the water bottle can be removed from the rack, where said closing means applies tension to a water bottle through a plurality of buffers to prevent damage to the water bottle and restrict the movement of the water bottle along the axis defined by the vertical, lateral and side supports of the rack, where said locking means is a plurality of cushioned tubes that are attached to the locking means which is attached to said rack frame and where said locking means is brought into contact with water bottles by said closing means.

2. A device as in claim 1 further comprising: being used to transport water bottles.

3. A device as in claim 1 further comprising: a closing means which applies tension to water bottles in said rack.

4. A device as in claim 1 further comprising: a closing means which applies tension to water bottles where said closing means s a hinging mechanism.

5. A device as in claim 1 further comprising: where said rack has a plurality of posts and where said closing means runs through a post and is attached to said rack.

6. device as in claim 1 further comprising: where said closing means provides a downward force that is transferred to the water bottles to hold them in place.

7. A device as in claim 1 further comprising: where said closing means applies tension to water bottles and where said locking means retains the tension via said cushioned tubes where closing means and locking means are attached to said rack frame.

8. A device as in claim 1 further comprising: where said locking means has a handle which pivots the locking means into either a tensioned or un-tensioned position.

9. A device as in claim 1 further comprising: where said hook extends from said poles at a ninety degree angle and extends inside the circumference of the bottom of the water bottle.

10. A device as in claim 9 further comprising: where said pole has pull knob attached to said pole on the opposite end to which said hook is attached.

11. A device as in claim 10 further comprising: where said buffering means consists of a plurality of tubes that conform to the diameter of the container when the handle on the rack is lowered into the locked position thereby restricting movement of the container.

12. A device comprising: a rack being used to transport water bottles where said rack has vertical, lateral and side supports, a trombone means which is comprised of a long pole with a hook in a track which is connected to the supports of said rack, a locking means connected to the supports of said rack and a closing means connected to the supports of said rack, where said trombone means connected to said rack is actuated by said pull knob and by which said hook moves a water bottle from the rear to the front of said rack positioning it so that the water bottle can be removed from the rack, where said closing means applies tension to a water bottle through a plurality of buffers to prevent damage to the water bottle and restrict the movement of the water bottle along the axis defined by the vertical, lateral and side supports, where said locking means is a plurality of cushioned tubes that are attached to the locking means which is attached to said rack frame and where said locking means is brought into contact with water bottles by said closing means and where the cushioned tubes are attached to the locking means and where the said locking means is brought into contact with the water bottles in said rack by said closing means where said closing means is a hinging mechanism which is attached to said rack which applies tension to water bottles in said rack and where the locking means is actuated by a handle which pivots the locking means into a tensioned or un-tensioned position.

13. A device as in claim 12 further comprising: where said rack has a plurality of posts and where said closing means runs through a post and is attached to said rack.

14. A device as in claim 12 further comprising: where said hook extends from said pole at a ninety degree angle and extends inside the circumference of the bottom of the water bottle.

15. A device as in claim 14 further comprising: where said pole has a pull knob attached to said pole on the opposite end to which said hook is attached.

16. A device as in claim 15 further comprising: where said buffering means consists of a plurality of tubes that conform to the diameter of the container when the handle on the rack is lowered into the locked position thereby restricting movement of the container.

17. A device comprising: a rack being used to transport containers where said rack has vertical, lateral and side supports of the rack, a trombone means which is comprised of a long pole with a hook in a track which is connected to the supports of said rack, a locking means connected to the supports of said rack and a closing means connected to the supports of said rack, where said trombone means connected to said rack is actuated by said pull knob and by which said hook moves a container from the rear to the front of said rack positioning it so that the container can be removed from the rack, where said closing means applies tension to a container through a plurality of buffers to prevent damage to the container and restrict the movement of the container along the axis defined by the vertical, lateral and side supports of the rack, where said locking means is a plurality of cushioned tubes that are attached to the locking means which is attached to said rack frame and where said locking means is brought into contact with containers by said closing means and where the cushioned tubes are attached to the locking means and where the said locking means is brought into contact with the containers in said rack by said closing means where said closing means is a hinging mechanism which is attached to said rack which applies tension to containers in said rack and where the locking means is actuated by a handle which pivots the locking means into a tensioned or un-tensioned position.

18. A device as in claim 17 further comprising: where said rack has a plurality of posts and where said closing means runs through a post and is attached to said rack.

19. A device as in claim 18 further comprising: where said pole has a pull knob attached to said pole on the opposite end to which said hook is attached.

20. A device as in claim 19 further comprising: where said buffering means consists of a plurality of tubes that conform to the diameter of the container when the handle on the rack is lowered into the locked position thereby restricting movement of the container.

21. A device as in claim 17 further comprising: where said container is a bottle, can, drum, or keg.

* * * * *